United States Patent [19]

Grims et al.

[11] Patent Number: 4,934,167

[45] Date of Patent: Jun. 19, 1990

[54] CAN BODY MAKING APPARATUS

[75] Inventors: Conrad M. Grims; Bert E. Johansson, both of Golden; Roger A. Hahn, Arvada, all of Colo.

[73] Assignee: Adolph Coors Company, Golden, Colo.

[21] Appl. No.: 392,446

[22] Filed: Aug. 11, 1989

Related U.S. Application Data

[63] Continuation-in-part of Ser. No. 69,840, Jul. 1, 1987, Pat. No. 4,807,459, Ser. No. 126,280, Nov. 30, 1987, abandoned, and Ser. No. 315,488, Feb. 27, 1989, abandoned.

[51] Int. Cl.[5] ..... B21D 22/21

[52] U.S. Cl. ..... 72/347; 72/456; 413/69

[58] Field of Search ..... 72/344, 347, 349, 449, 72/450, 456; 384/12, 13, 315, 316; 413/69

[56] References Cited

U.S. PATENT DOCUMENTS

| | | | |
|---|---|---|---|
| 2,008,527 | 7/1935 | Warren | 384/315 |
| 2,924,491 | 2/1960 | Wallgren | 384/13 |
| 3,003,411 | 10/1961 | Judd | 100/98 R |
| 3,168,013 | 2/1965 | Williamson | 92/112 |
| 3,231,319 | 1/1966 | Porath | 384/12 |
| 3,442,326 | 5/1969 | Porcherot | 384/315 X |
| 3,466,951 | 9/1969 | Greenberg | 384/12 X |
| 3,508,430 | 4/1970 | Edmondson | 72/456 |
| 3,696,657 | 10/1972 | Maytag | 72/456 |
| 3,735,629 | 5/1973 | Paramonoff | 72/349 |
| 3,955,394 | 5/1976 | Kaufman et al. | 72/344 |
| 4,048,841 | 9/1977 | Kent | 72/450 |
| 4,173,138 | 11/1979 | Main et al. | 72/349 |
| 4,530,228 | 7/1985 | Snyder et al. | 72/349 |
| 4,578,981 | 4/1986 | Nishikawa et al. | 72/347 |
| 4,614,104 | 9/1986 | Straw | 72/347 |

FOREIGN PATENT DOCUMENTS

| | | | |
|---|---|---|---|
| 661672 | 8/1987 | Switzerland | 72/456 |

OTHER PUBLICATIONS

Analysis and Design of Sliding Bearings, Lubrication Principles, pp. 5-66 Thru 5-73 10" Block-Head Universal Air Bearing Spindle.

*Primary Examiner*—E. Michael Combs

*Attorney, Agent, or Firm*—Klaas & Law; Joseph J. Kelly; Bruce G. Klaas

[57] ABSTRACT

A redraw apparatus is provided for a can body making apparatus wherein the redraw carriage of the redraw apparatus is mounted for substantially friction-free sliding reciprocating movement over a pair of spaced apart support posts which are fixed mounted on the housing holding the can forming and ironing dies. Also, the counterbalancing system is provided for applying a force to counterbalance the weight of a portion of structures used to reciprocate the redraw carriage. Additionally, a ram assembly is provided for supporting a ram for movement through the redraw apparatus and the can forming and ironing dies wherein a pair of spaced apart elongated shafts are fixedly mounted and a ram carriage having the ram attached thereto is provided with liquid bearings using liquid coolant comprising water having solubles contained therein for mounting the ram carriage on the elongated shafts for substantially friction free movement thereover. A guide liquid bearing is also used to ensure proper alignment of the ram. Also disclosed is a reciprocating ram which is supported solely by a liquid bearing wherein the liquid bearing using liquid coolant comprising water having solubles contained therein has a sufficient length to ensure the proper alignment of the leading portion of the elongated ram as it engages a can blank in a redraw assembly and moves it through the forming and ironing dies to form an elongated can body.

38 Claims, 9 Drawing Sheets

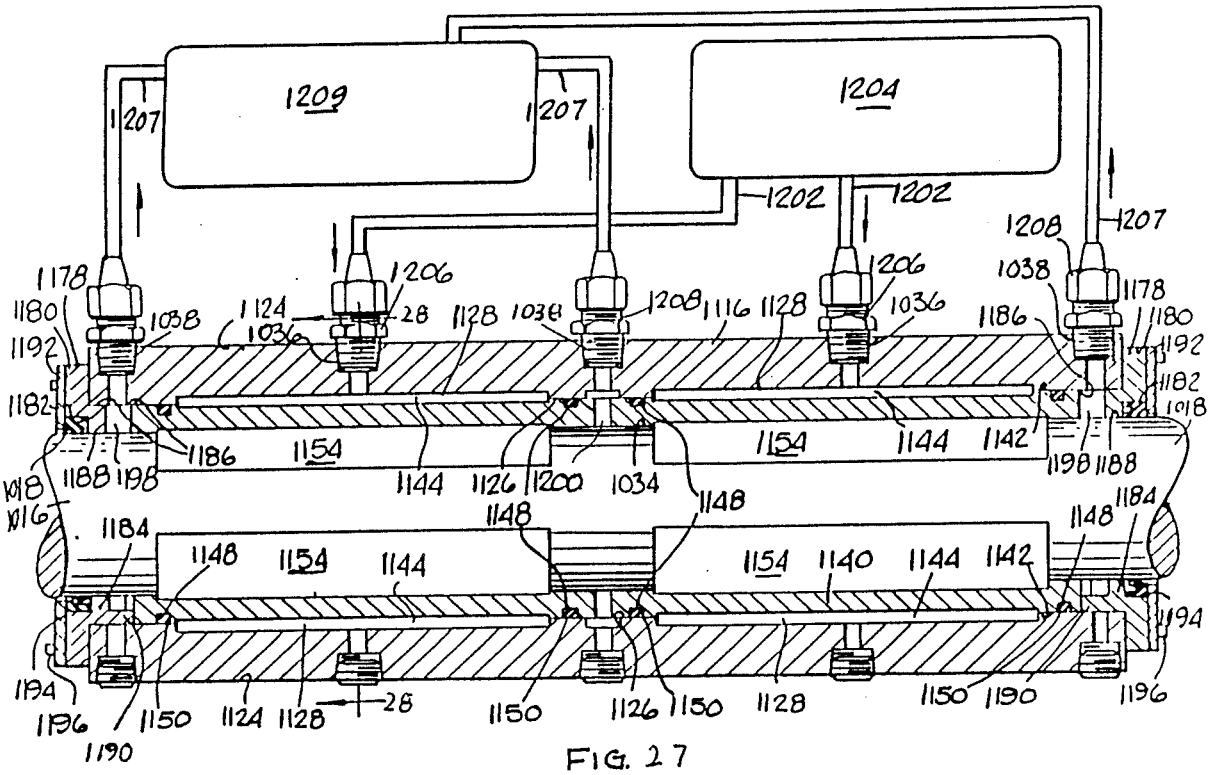
FIG. 27
FIG. 26
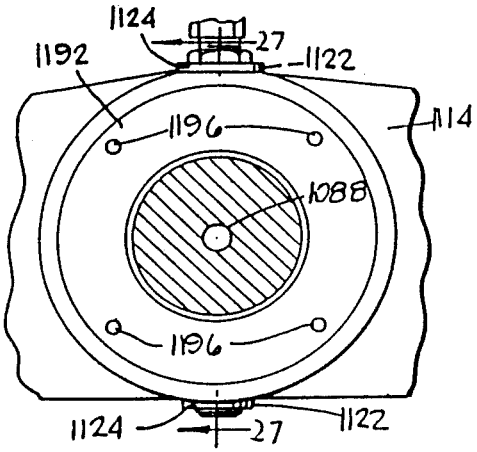
FIG. 28
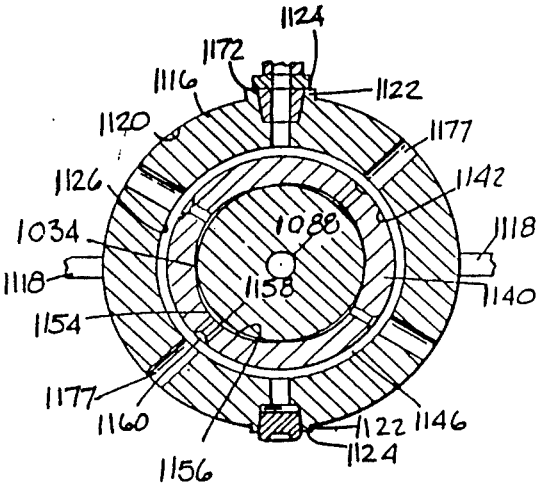
FIG. 29
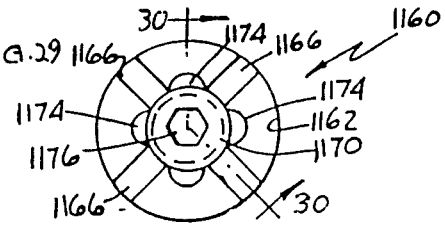
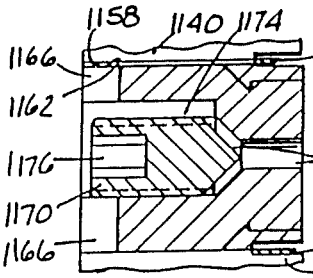
FIG. 30

CAN BODY MAKING APPARATUS

This application is a continuation-in-part of U. S. patent application Ser.l No. 069,840 filed July 1, 1987, now U.S. Pat. No. 4,807,459 issued Feb. 28, 1989; of Ser. No. 126,280 filed Nov. 30, 1987 abandoned and of Ser. No. 315,488 filed Feb. 27, 1989.

FIELD OF THE INVENTION

This invention relates generally to a can body making apparatus and more particularly to an improvement in the ram assembly apparatus for maintaining more accurate alignment of the ram during the reciprocation thereof and in the redraw apparatus for providing and maintaining more accurate alignment of the can blanks with the ram and the tool pack containing the can forming and ironing dies.

BACKGROUND OF THE INVENTION

A can body making apparatus is disclosed in U.S. Pat. No. 3,696,657 issued to J. H. Maytag, which is incorporated herein by reference. The ram carriage and redraw carriage are each mounted on rollers which move over carriage way strips, as illustrated in FIGS. 5 and 12 thereof. Each pair of upper and lower rollers are urged toward each other so as to be in firm contact with the carriage way strip located therebetween. Both the ram and redraw carriages are reciprocated at rates sufficient to form about two hundred cans a minute. The constant reciprocal movement of the ram and redraw carriages and the tight engagement of the rollers on the carriage way strips result in wear which causes misalignment of the ram or of the can blanks by the redraw sleeve. It is understood that this misalignment is small, between about 0.005 and 0.010 of an inch, but such misalignment can result in defective cans.

BRIEF DESCRIPTION OF THE INVENTION

This invention provides ram assembly means for a can body making apparatus wherein ram means are mounted on ram carriage means which have a pair of liquid bearing means for mounting the ram carriage means for reciprocal movement over a pair of fixedly mounted, spaced apart, elongated shafts. Also, guide means, such as liquid bearing means, are provided for guiding the reciprocal movement of the ram means therethrough.

This invention also provides a ram assembly wherein an elongated ram for a can body making apparatus which is connected to apparatus for producing a straight line reciprocating motion and is supported solely by a liquid bearing during the reciprocation thereof in a can body making operation wherein the liquid bearing has a sufficient length to ensure the maintenance of proper alignment for the leading portion of the elongated ram as it engages a can blank in the redraw assembly and moves it through the forming and ironing dies to form an elongated can body even if there is some misalignment of the apparatus for producing the straight line reciprocating motion.

This invention also provides a redraw apparatus for a can body making apparatus wherein the redraw carriage is slidably mounted on a pair of spaced apart support posts for reciprocal movement thereover, which support posts are fixedly mounted on the housing holding the can forming and ironing dies. The invention also provides counterbalancing means for supporting at least a major portion of the weight of the redraw actuating rod, also known as the push rod, to substantially eliminate the weight on the carriage sleeve for more efficient operation.

In one preferred embodiment of the invention, ram assembly means are provided for a can body making apparatus having means for reciprocating a ram carriage means and a ram means along their longitudinal axes so that the ram means push a can blank through can forming and ironing dies to form a can body. The ram assembly means include a pair of spaced apart, elongated shafts having generally cylindrical outer surfaces and which are fixedly mounted on a fixed frame means. The ram means are mounted on a ram carriage means that have a pair of spaced apart liquid bearing means each having a cylindrical inner surface for reciprocal movement over the elongated shafts. The liquid bearing means has a plurality of arcuately shaped pocket means, each of which is supplied with a liquid, preferably from the coolant supply of the can body making apparatus, at suitable pressures. Each liquid bearing means also has liquid return means for removing the liquid supplied to the pocket means. Guide means, preferably comprising liquid bearing means, are fixedly mounted on the frame means and are located so that the ram means are supported for reciprocal movement therethrough. A redraw carriage including a redraw sleeve is located between the ram assembly means and the can forming and ironing dies and functions to hold a can blank in the proper position against the can forming and ironing dies so that the ram means will push the can blank through the can forming and ironing dies to form a can body. The redraw apparatus includes a redraw carriage that is provided with a pair of spaced apart bearings having generally cylindrical inner surfaces. A pair of spaced apart support posts are fixedly mounted on the housing holding the can forming and ironing dies and have generally cylindrical outer surfaces. The redraw sleeve is slidably mounted on the spaced apart support posts for substantially friction free movement thereover. The longitudinal axes of the spaced apart support posts and bearings are parallel to the longitudinal axis of the ram means and the redraw sleeve holds the can blank so that the longitudinal axis thereof is aligned with the longitudinal axis of the ram means. Reciprocating means are provided for providing reciprocal movement of the redraw carriage over the spaced apart support posts. A counterbalancing means, comprising a plurality of springs mounted in a fixed position and applying a force against a portion of the reciprocating means, removes substantially all of the weight on the redraw carriage to virtually eliminate wear of the bushings and posts.

In another preferred embodiment of the invention, an elongated ram is provided and has a main body portion having a generally cylindrical outer peripheral surface and a first end portion on which there is mounted a punch sleeve which moves into the redraw assembly to engage a can blank and then moves the can blank through the forming and ironing dies to form the can blank into an elongated can body. The elongated ram has a second end portion, opposite to the first end portion, which is mounted in connecting means for connecting the second end portion to the apparatus for producing a reciprocating linear motion The main body portion is mounted for sliding movement through a liquid bearing having a generally cylindrical inner surface having a diameter only slightly greater than the diameter of the generally cylindrical outer peripheral surface of the main body portion. The liquid bearing is fixedly mounted on the support frame. Inlet means are provided for supplying liquid to the liquid bearing and outlet means are provided for removing liquid from the liquid bearing. The liquid preferably comprises a portion of the coolant used to cool the forming and ironing dies and is passed through the liquid bearing at a rate sufficient to maintain the various portions of the elongated ram at desired temperatures. As described above, the elongated ram is supported solely by the liquid bearing and the liquid bearing has a sufficient length to ensure the maintenance of proper alignment for the first portion of the elongated ram as it engages a can blank in the redraw assembly and moves it through the forming and ironing dies to produce an elongated can body. The difference in diameter between the generally cylindrical outer surface of the main body portion and the generally cylindrical inner surface of the liquid bearing is between about 0.0006 and 0.0012 of an inch. The pressure in the liquid bearing is between about 100 and 500 psi and preferably is about 250 psi.

BRIEF DESCRIPTION OF THE DRAWING

Illustrative and presently preferred embodiments of the invention are shown in the accompanying drawings in which:

FIG. 26 is an end elevational view of the liquid bearing;

FIG. 27 is a cross-sectional view taken on the line 27—27 of FIG. 26;

FIG. 28 is a cross-sectional view taken on the line 28—28 of FIG. 27;

FIG. 29 is an end elevational view of an adjustable fitting; and

FIG. 30 is a cross-sectional view taken on the line 30—30 of FIG. 29.

DETAILED DESCRIPTION OF THE INVENTION

Figure 1:
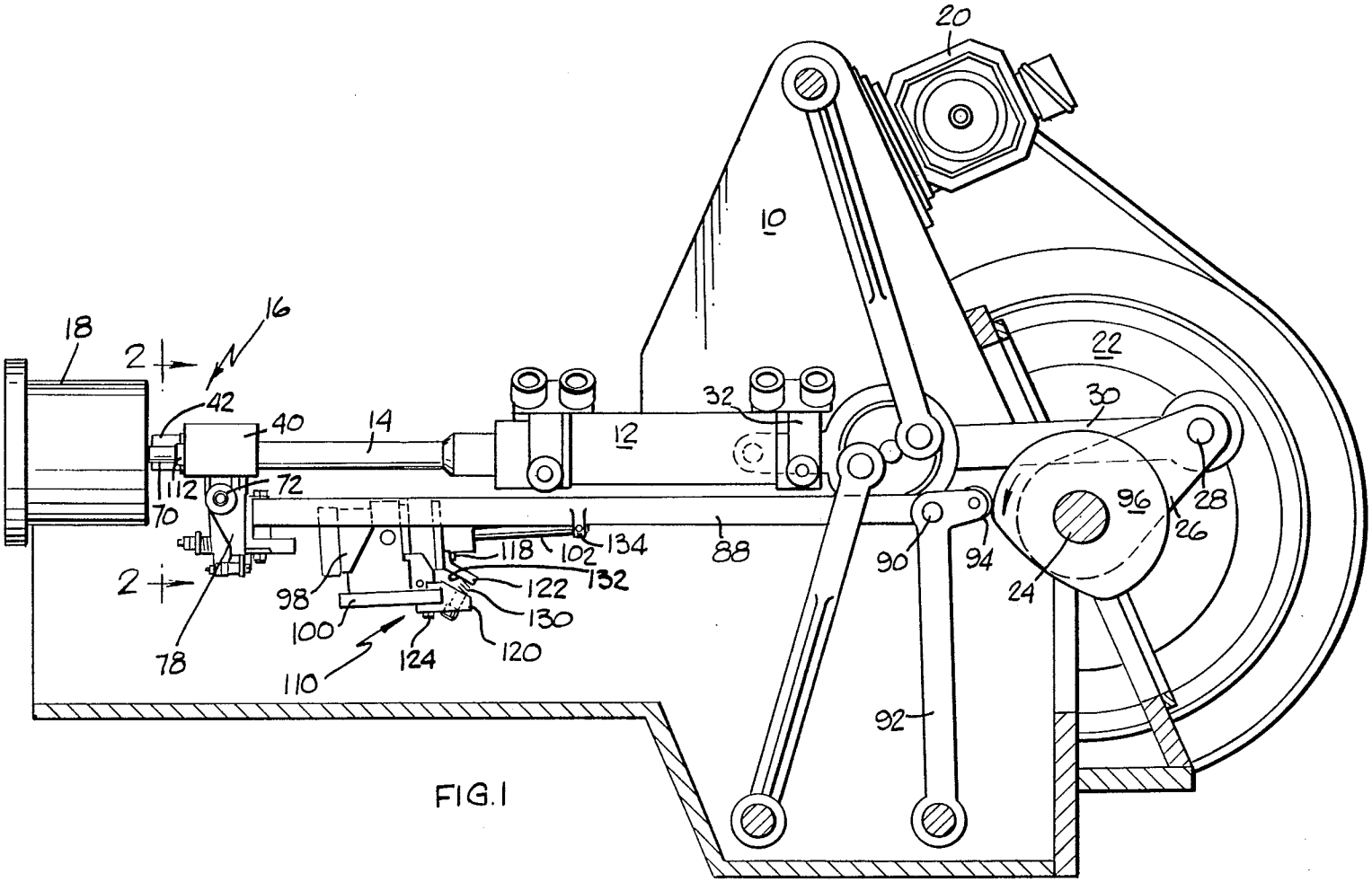
FIG. 1 is a side elevational view similar to FIG. 6 of the Maytag patent.
Figure 6:
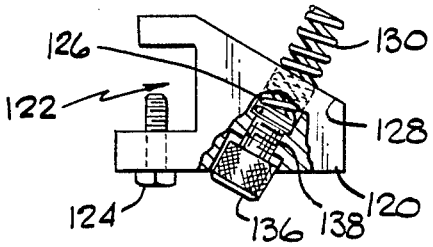
FIG. 6 is a side elevational view of the spring holding means of the counterbalancing means.

The apparatus illustrated in FIG. 1 corresponds to that illustrated in FIG. 6 of the Maytag patent. A frame 10 has a ram carriage 12 mounted thereon for reciprocating movement over a pair of spaced apart opposed way strips (not shown). The ram carriage 12 has a ram 14 mounted thereon so that during the forward stroke, the ram 14 will pass through the redraw apparatus 16, having a cup feeding means 17, and through the housing 18 containing the can forming and ironing dies similar to those in U.S. Pat. No. 3,735,629 to Paramonoff, which is incorporated herein by reference. The mechanism for reciprocating the ram carriage 12 includes the motor 20, the pulley wheel 22, the crank shafts 24, the crank arms 26, the crank pins 28, the main connecting rod 30 and cross-head members 32, all of which are conventional.

The redraw apparatus 102 of this invention is illustrated in FIGS. 1–4 and comprises a redraw carriage 40 having a conventional redraw sleeve 42. The redraw carriage 40 is provided with a pair of spaced apart longitudinally extending bores 44 and 46 which are located on both sides of bushing 48 mounted in the redraw carriage 40. One end of each bore 44 and 46 is enlarged and bearing means 50 and 52 are fixedly mounted therein. The bearing means 50 and 52 preferably comprise a hardened steel bushing having a cylindrical inner surface 54. The redraw carriage 40 is also provided with a pair of bores 56 in which are mounted rocker pivots 58 similar to those in the Maytag patent. The redraw carriage 40 also is provided with passageways 60. A rocker arm 62 similar to the one in the Maytag patent has extensions 64 which extend through the passageways 60 and are pivotally mounted on the rocker pivots 58 to provide the force to reciprocate the redraw carriage 40.

A pair of spaced apart support posts 70 and 72 are fixedly mounted on the housing 18 holding the can forming and ironing dies (not shown). Each of the support posts 70 and 72 has a cylindrical outer surface 74 and has a longitudinal axis extending parallel to the longitudinal axis of the ram 14. The redraw carriage 40 is slidably mounted on the support posts 70 and 72 by placing the bearing means 50 and 52 over the support posts 70 and 72. Conventional fittings 76 are provided for supplying lubrication for the bearing means 50 and 52. This slidable mounting of the redraw carriage, as illustrated in FIGS. 1–4, is substantially friction-free and minimizes any wear caused by the reciprocating movement of the redraw carriage so that proper alignment of the redraw sleeve with the ram assembly and the housing holding the can forming and ironing dies is maintained.

Figure 2:
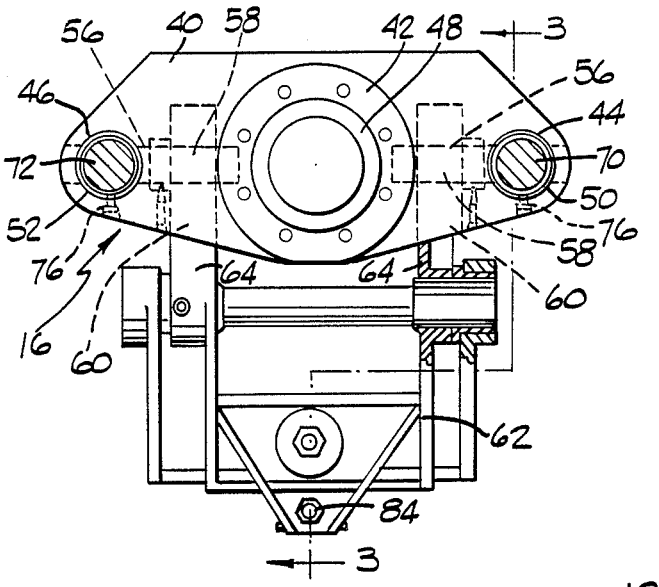
FIG. 2 is an elevational view with parts in section taken on the, line 2—2 of FIG. 1.
Figure 5:
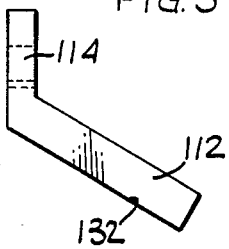
FIG. 5 is a side elevational view of a plate means forming a part of the counterbalancing means.
Figure 3:
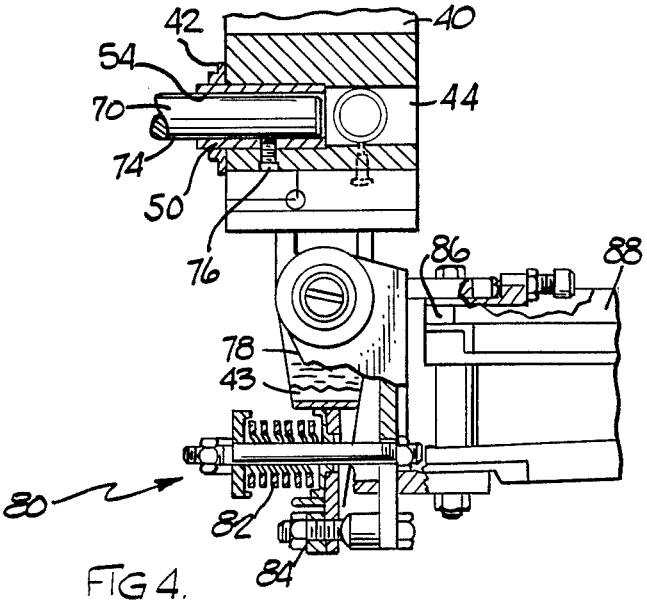
FIG. 3 is an elevational view with parts in section taken along the line 3—3 of FIG. 2.
Figure 7:
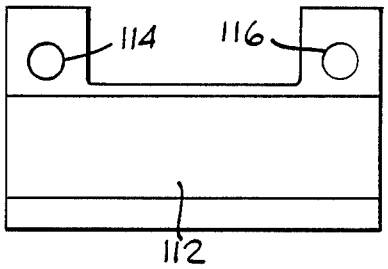
FIG. 7 is a front elevational view of FIG. 5.
Figure 4:
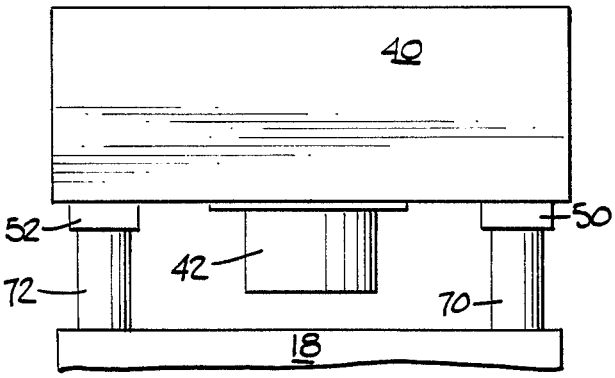
FIG. 4 is a top plan view of a portion of FIG. 2.
Figure 8:
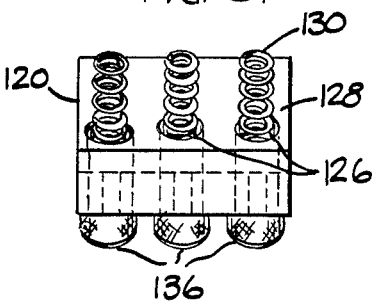
FIG. 8 is a front elevational view of FIG. 6.

The redraw carriage 40 is reciprocated by conventional mechanism as illustrated in FIGS. 1–3. The rocker arm 62 is attached to a shoe 78 which supports the conventional movement arresting means 80 including the spring 82 and adjustable stop screw 84. The shoe 78 is attached to the end 86 of the actuating rod 88 and the end 90 of the actuating rod 88 is pivotally connected to the cam follower lever 92 having a cam follower 94 which is urged against a cam 96 rotated by the wheel 22. An air cylinder 98 is mounted on a fixed support 100 with the free end of its piston rod 102 pivotally connected to the actuating rod 88 at approximately the mid-point thereof. The air cylinder 98 exerts a constant force on the actuating rod 88 through the piston rod 102 to maintain the cam follower 94 in contact with the cam 96 to provide the reciprocating movement to the redraw carriage 40.

A counterbalancing means 110, illustrated in FIGS. 1 and 5–8, is provided for applying a force on the redraw actuating bar 88 so as to substantially eliminate any weight on the redraw carriage 40. The counterbalancing means 110 comprises an angularly shaped member 112 having passageways 114 and 116 so that it may be secured by headed bolts 118 to the housing of the air cylinder 98. A support member 120 having a U-shaped opening 122 is positioned on the support 100 and secured thereto by a set screw 124. A plurality of holes 126 are formed in the support member 120 and extend partially therethrough and have openings in the upper surface 128 thereof. A coiled spring 130 is located in each hole. As illustrated in FIG. 1, the support member 120 is located relative to the member 112 so that the coiled springs 130 are in contact with a generally planar bottom surface 132 on the member 112. Pivot means 134 are provided for pivotally connecting the end of the piston rod 102 to the redraw actuating bar 88. This pivot means 134 is connected to the redraw actuating bar 88 at a generally central location. The coiled springs 130 function to provide a force on the member 112 so as to counterbalance the weight of the redraw actuating bar 88 and its associated structures so that there is substantially no weight placed on the redraw carriage 40. Set screws 136 are threadedly mounted in threaded bores 138 in the support member 120 so that the ends thereof are in contact with the coiled springs 130 so that the amount of force being applied by the coiled springs 130 may be adjusted This counterbalancing means 110 virtually eliminates any wear of the bushing means 50 and 52 and the support posts 70 and 72 so that proper alignment of the redraw sleeve with the ram assembly and the housing holding the can forming and ironing dies is maintained.

The redraw carriage 40 and the redraw sleeve 42 are reciprocated over the support posts 70 and 72 to position a can blank (not shown) to be contacted by the ram 14 and be pushed through the can forming and ironing dies in the housing 18 to form a can body.

Figure 9:
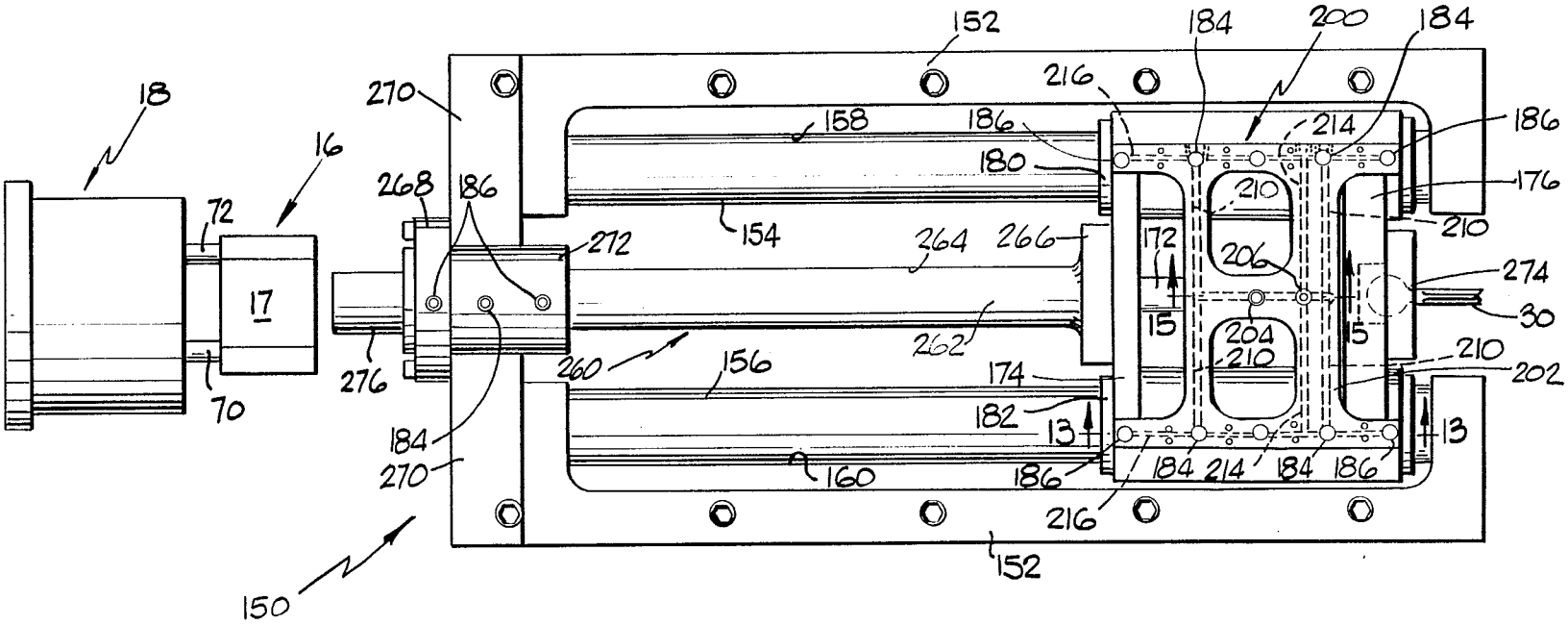
FIG. 9 is a top plan view of the ram assembly means to be substituted for those in FIG. 1.
Figure 12:
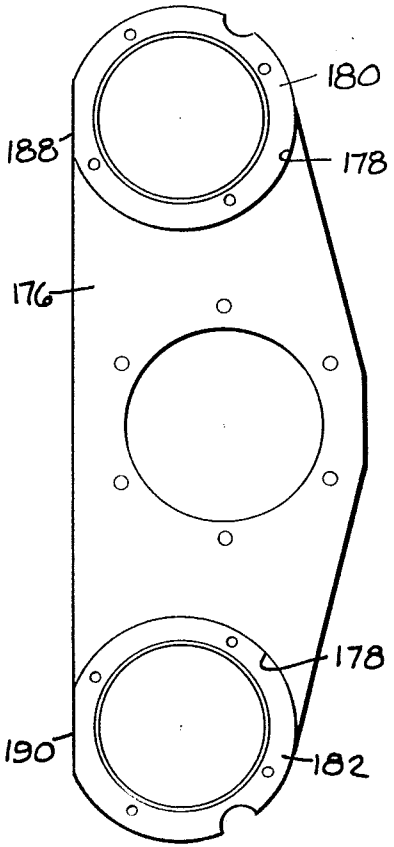
FIG. 12 is a right side elevational view of FIG. 10.
Figure 10:
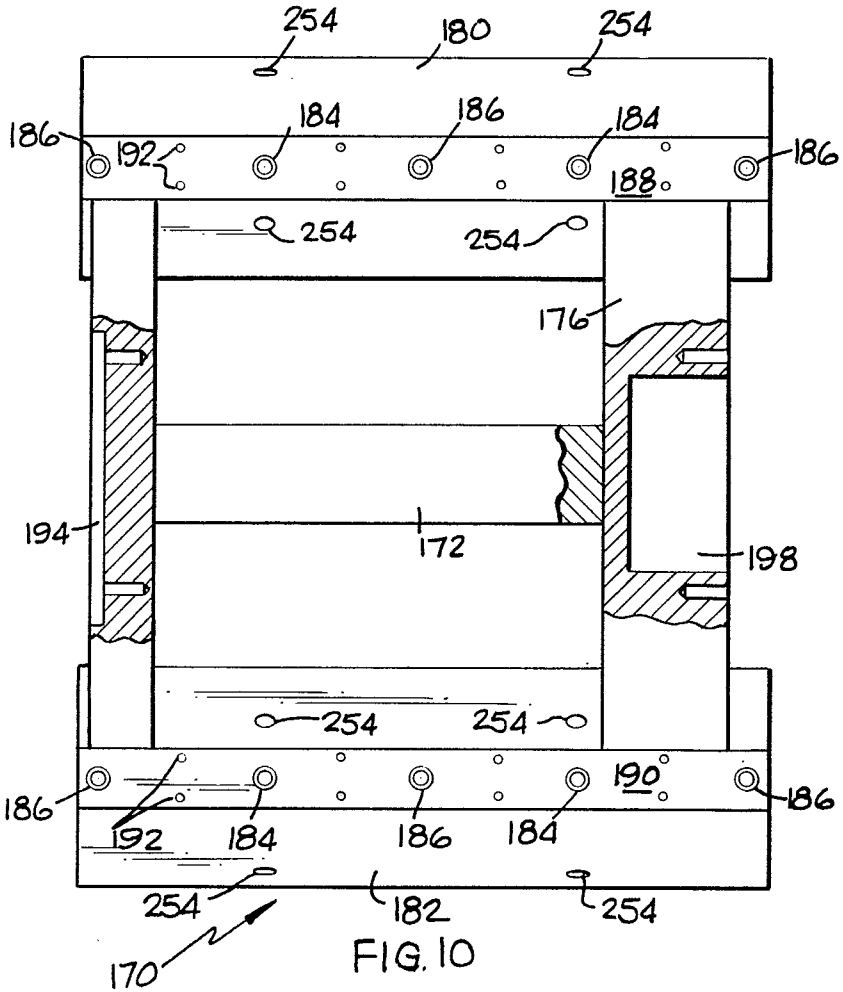
FIG. 10 is a top plan view of the ram carriage means of FIG. 9.
Figure 11:
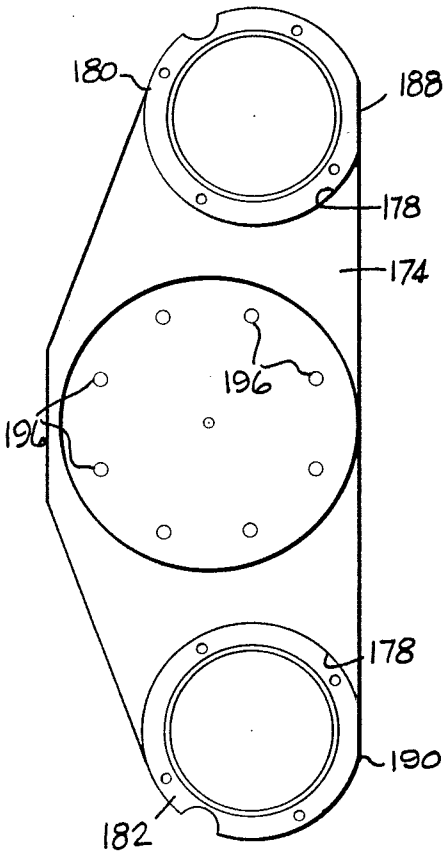
FIG. 11 is a left side elevational view of FIG. 10.

Ram assembly means 150, to be substituted for the ram assembly means of FIG. 1, are illustrated in FIG. 9 and comprise a fixed support frame means 152 secured to a foundation (not shown). A pair of spaced apart, elongated shafts 154 and 156 are secured at a fixed location on the support frame means 152 by suitable means (not shown). The elongated shafts 154 and 156 have generally cylindrical outer surfaces 158 and 160. Ram carriage means 170 are illustrated in FIGS. 10–12 and include a generally rectangularly shaped central body portion 172 and two end members 174 and 176 having arcuately shaped end surfaces 178. Liquid bearing means 180 and 182 are secured to the arcuately shaped end surfaces 178 by suitable means, such as by welding. The liquid bearing means 180 and 182 have a plurality of liquid inlet means 184 and a plurality of liquid outlet means 186 for purposes described below. Also, the top surfaces 188 and 190 of the liquid bearing means 180 and 182 are generally planar and are provided with a plurality of threaded bores 192 for mounting a manifold means thereon as described below. A central recess 194 is formed in the end member 174 and has a plurality of spaced apart threaded bores 196 for mounting the ram means as described below. A central cavity 198 is formed in the end member 176 and is dimensioned to be coupled to the drive means for reciprocating the ram carriage means 170 as described below.

Manifold means 200, illustrated in FIGS, 9, 13 and 15, are secured to the top surfaces 188 and 190 by suitable means (not shown) such as threaded bolts in the threaded bores 192. The manifold means 200 has a main body portion 202 having a liquid inlet means 204 and a liquid outlet means 206. A passageway 208 receives liquid from the liquid inlet means 204 and distributes the liquid through branch passageways 210 through the liquid inlet mean 184 of the liquid bearing means 180 and 182 to an annular passageways 212. Liquid is removed from the liquid bearing means 180 and 182 through a passageway 214 connected to branch passageways 216 which receive liquid from radially extending passageways 218 in liquid communication with the liquid outlet means 186 in the liquid bearing means 180 and 182 and pass such liquid through liquid outlet means 206 and then to a drain basin, as described below.

Figure 13:
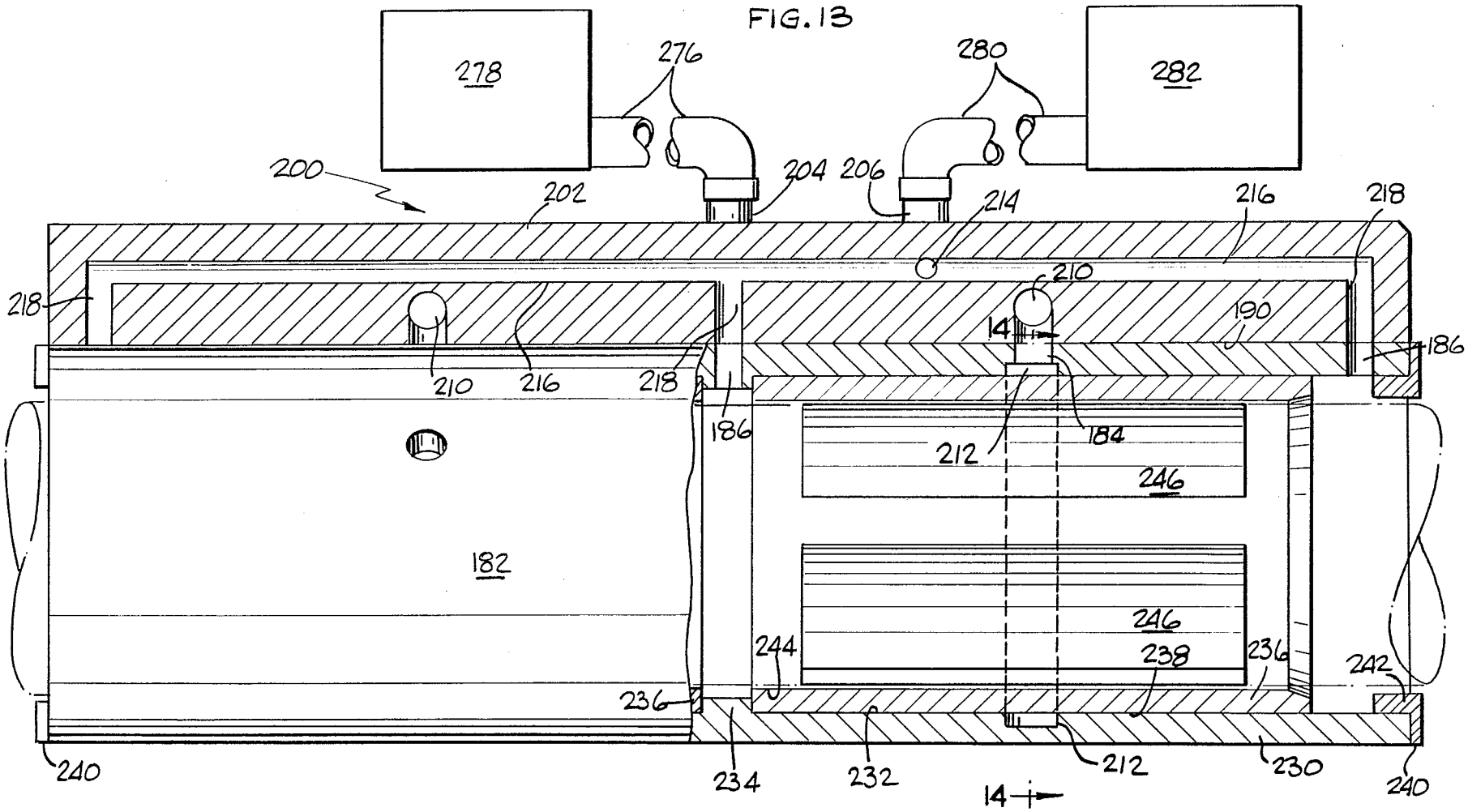
FIG. 13 is a cross-sectional view taken on the line 13—13 of FIG. 9.
Figure 15:
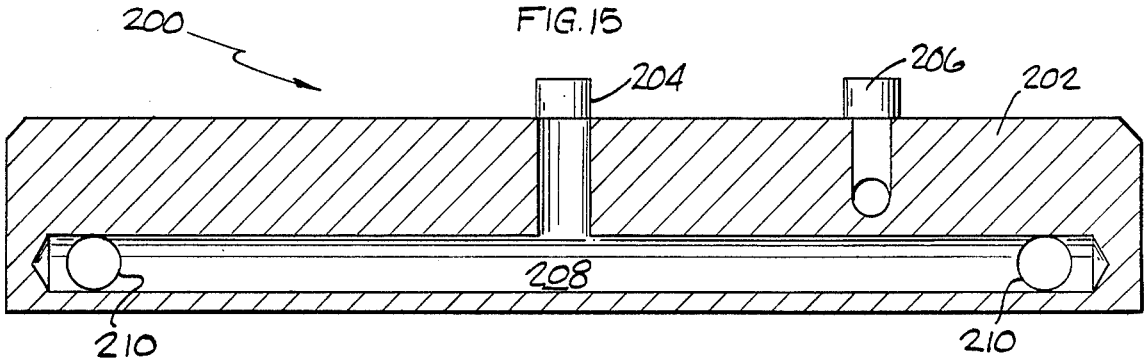
FIG. 15 is a cross-sectional view of the manifold means taken on the line 15—15 of FIG. 9.
Figure 14:
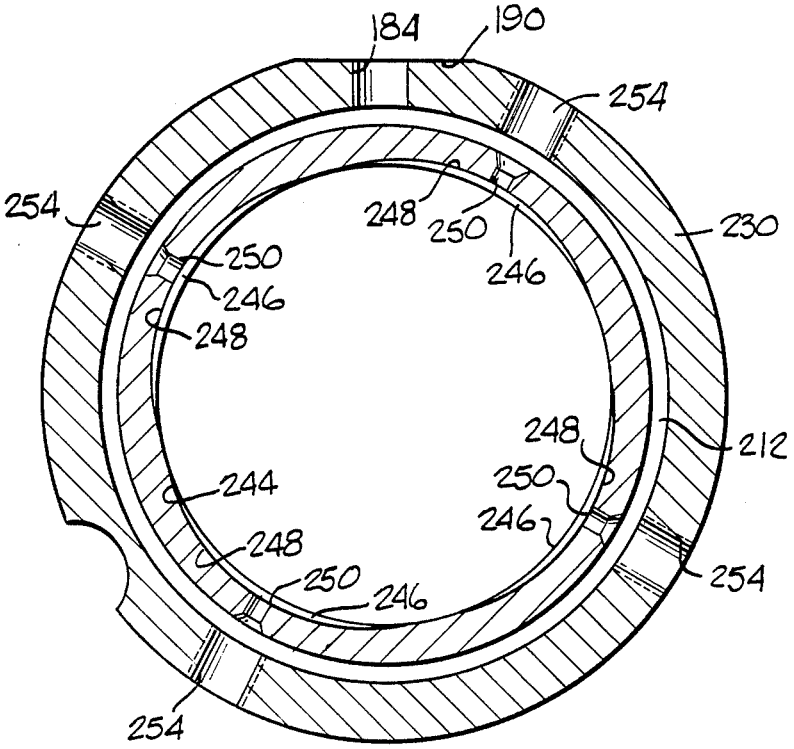
FIG. 14 is a cross-sectional view taken on the line 14—14 of FIG. 13.
Figure 16:
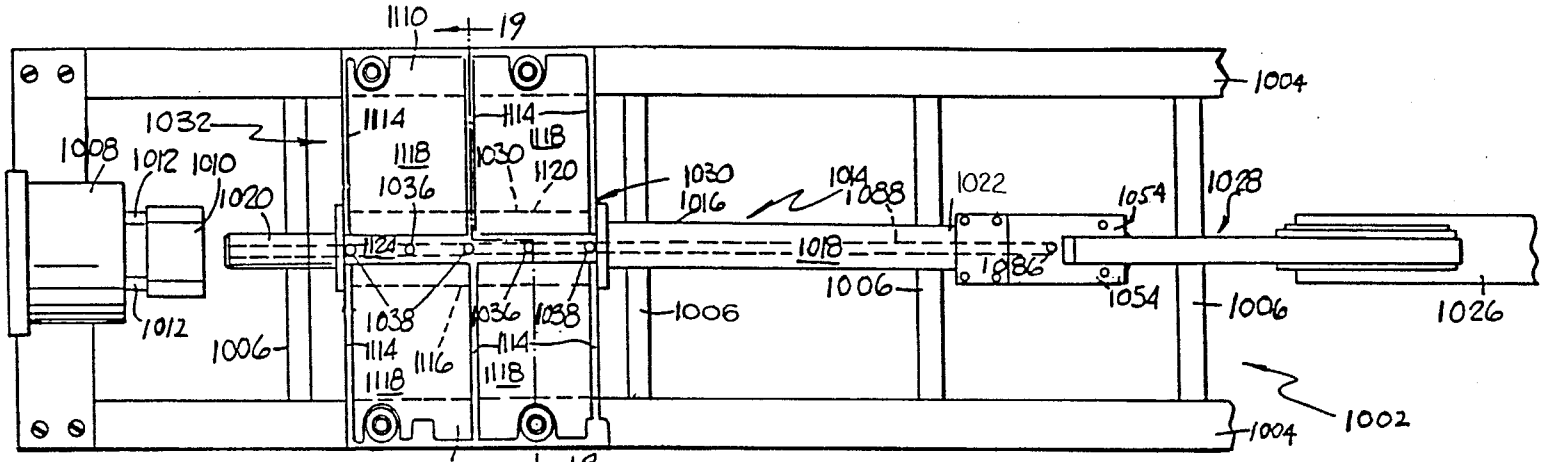
FIG. 16 is a top plan view of the preferred embodiment of this invention.
Figure 17:
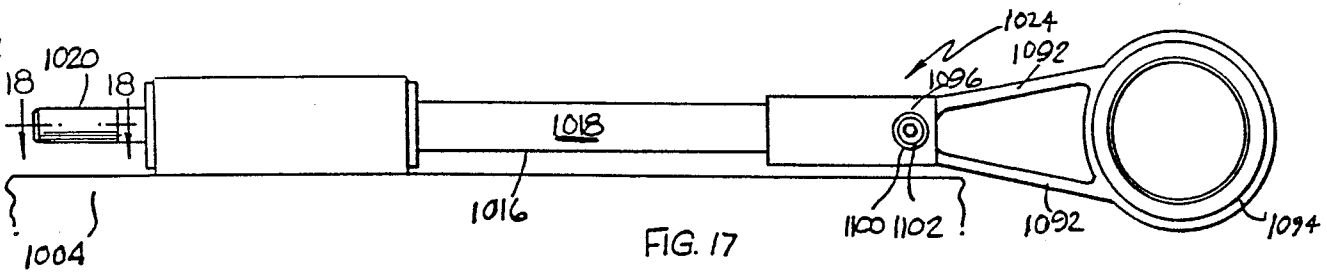
FIG. 17 is a side elevation of a major portion of FIG. 16.
Figure 18:
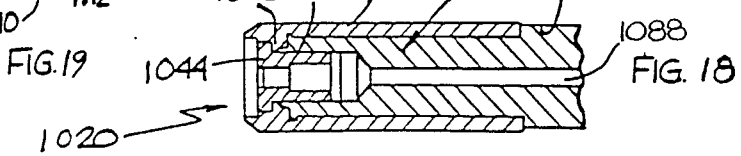
FIG. 18 is an enlarged cross-sectional view taken on the line 18—18 of FIG. 17.
Figure 19:
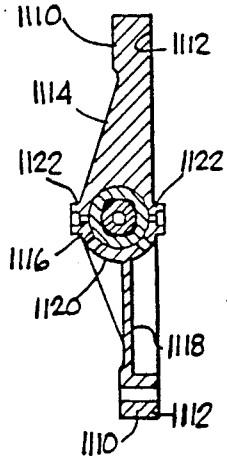
FIG. 19 is a cross-sectional view taken on the line 19—19 of FIG. 16.
Figure 20:
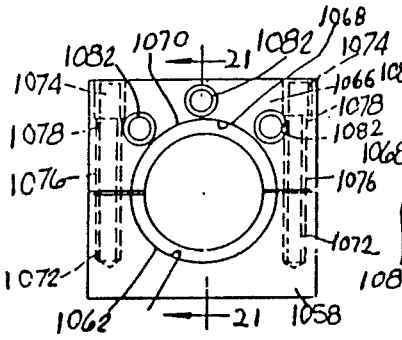
FIG. 20 is an end elevational view of a portion of the connecting means before the elongated ram is connected thereto.
Figure 21:
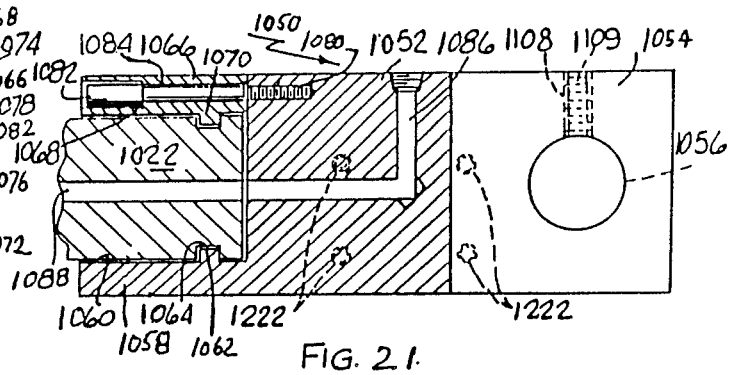
FIG. 21 is a cross-sectional view taken on the line 21—21 of FIG. 20.
Figure 22:
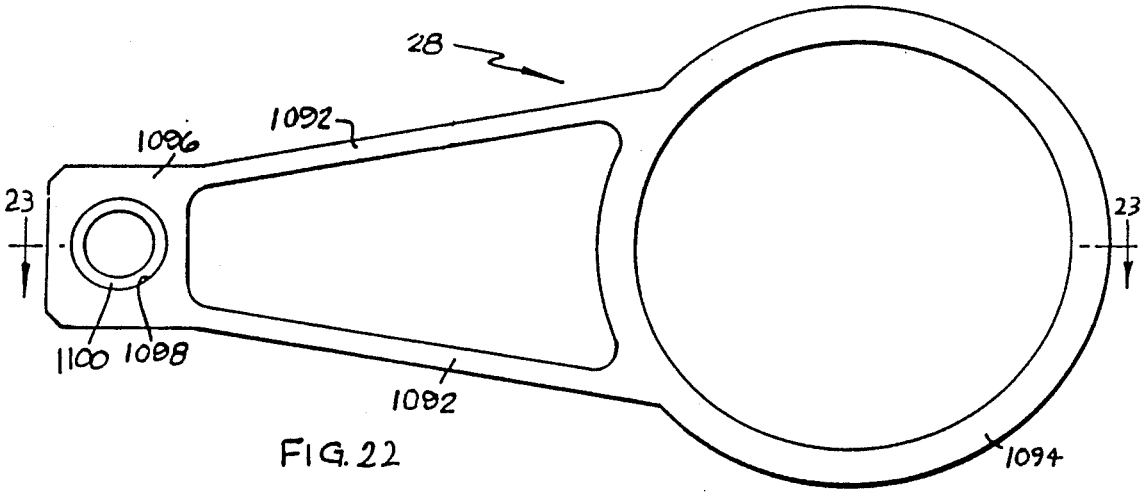
FIG. 22 is a side elevational view of the connecting means.
Figure 23:
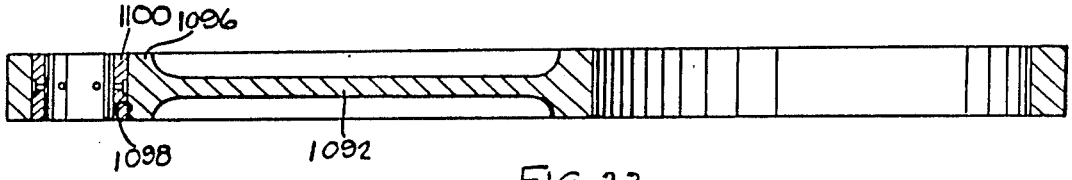
FIG. 23 is a cross-sectional view taken on the line 23—23 of FIG. 22.
Figure 24:
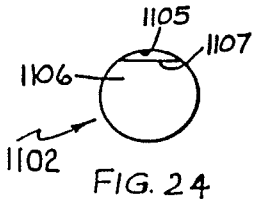
FIG. 24 is an end elevational view of a connecting pin.
Figure 25:
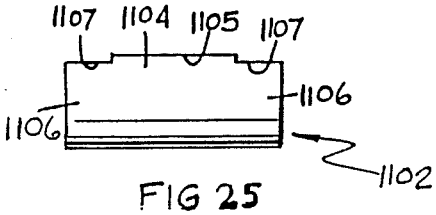
FIG. 25 is a side elevational view of FIG. 24.

The liquid bearing means 182 are illustrated more particularly in FIGS. 13 and 14 and comprise a hollow elongated housing means 230 having the generally planar top surface 190 and a generally cylindrical inner surface 232 having a centrally located radially inwardly projecting flange portion 234. Two liquid bearing members 236 each having a generally cylindrical outer surface 238 having substantially the same diameter as the generally cylindrical surface 232 are positioned in mating relationship therewith and in abutting relationship with the flange portion 234. An end closing member 240 having an axially inwardly projection portion 242 is secured to the elongated housing by suitable means (not shown), such as bolts in threaded bores, to restrict the flow of the liquid out of the bearing members 236 so that the liquid will flow through the liquid outlet means 186. Each liquid bearing member 236 has a generally cylindrical inner surface 244 in which are formed a plurality of spaced apart pocket cavities 246 each of which has an arcuate surface 248 which is a portion of a cylindrical surface having an axis offset from the axis of the general cylindrical inner surface 244. A centrally located radially extending passageway 250 is in liquid communication with each pocket cavity 246 and the annular passageway 212. Suitable fittings (not shown) are mounted in each passageway 250 to control the flow of liquid into each pocket cavity 246. Access openings 254 are provided for permitting insertion or adjustment of the fittings and when the bearings are in use, these access openings 254 are sealed with plug means (not shown).

Ram means 260 are illustrated in FIG. 9 and comprise a ram 262 having a generally cylindrical outer surface 264 having substantially the same diameter as the inner diameter of the can body to be formed. The ram 262 has an integral flanged portion 266 which is positioned in the central recess 194 and secured therein by suitable means (not shown) such as bolts secured in the threaded bores 196. Guide means 268 are fixedly mounted in support members 270 fixedly secured to the support frame means 152. The guide means 268 comprise liquid bearing means 272 similar to liquid bearing means 180 and 182 except that the housing means thereof contains only one liquid bearing member 236. Manifold means (not shown) will provide liquid to the liquid inlet means 184 and remove liquid from the liquid outlet means 186. The longitudinal axes of the elongated shafts 154 and 156, the liquid bearing means 180, 182 and 272 and the ram means 260 are in parallel relationship with each other. A ball and socket means 274 is used to connect the end member 176 to the main connecting rod 30. It is understood that suitable fittings and sealing members are used where necessary to control the flow of the liquid. In the preferred embodiment, the liquid used is taken from the pool of coolant used conventionally with can body making apparatus.

In the operation of the apparatus illustrated in FIGS. 9–15, the ram carriage assembly 150 is mounted on the fixed support frame means 152 so that the front end portion 276 of the ram 262 will pass through the redraw apparatus 16 and the housing 18 containing the can forming and ironing dies. Liquid conducting means 276 are connected to the liquid inlet means 204 and a coolant storage tank 278 to provide coolant from the coolant storage tank 278 as the liquid to each of the liquid bearing means 180 and 182. The coolant is provided at suitable pressures so that the pressure in each of the pocket cavities 246 is between about 150 and 500 psi and preferably about 200 psi. The coolant comprises about 97 percent water to which are added solubles. Liquid conducting means 280 are connected to the liquid outlet means 206 and to a drain basin 282 for removing coolant passing through the liquid bearing means 180 and 182. The connecting rod 30 applies reciprocating forces on the ram carriage means 170 so that the ram 262 moves back and forth through the redraw apparatus 16 and the housing 18 so as to form can bodies at the rate of between about 150 and 300 can bodies per minute The liquid bearing members 236 permit substantially friction free movement of the ram carriage means over the elongated shafts 154 and 156 and ram 262 through the liquid bearing means 272 so that there is substantially no wear to cause misalignment problems. Also, the liquid bearing members 236 provide pressure equalization means so that the ram carriage means move over the elongated shaft means 154 and 156 in an equilibrium position. The ram assembly means of this invention weighs less than that illustrated in the Maytag patent so that it may be moved using substantially less power. The lighter weight also allows the reciprocation to be reversed more easily so that more cans may be produced each minute. Also, by substantially eliminating wear, downtime and maintenance are substantially reduced.

Another preferred embodiment of the invention is illustrated in FIGS. 16–32 and comprises a support frame 1002 comprising a pair of spaced apart linearly extending support beams 1004 in parallel relationship and having support legs fixedly mounted on a floating support surface as conventional in the art (not shown) A plurality of cross-beams 1006 extend between and are connected to the support beams 1004 to provide a rigid support structure A housing 1008 having conventional can forming and ironing dies located therein is fixedly mounted on the support beams 1004 suitable means such as nuts and bolts. A conventional redraw assembly 1010 is slidably mounted on a pair of spaced apart posts 1012 by conventional means (not shown) Reciprocating means such as those described in U.S. Pat. No. 4,807,459 issued Feb. 28, 1989, can be provided to reciprocate the redraw assembly 10.

An elongated ram 1014 is provided and has a main body portion 1016 having a generally cylindrical outer peripheral surface 1018. The elongated ram 1014 has a first end portion 1020, described more fully below, for movement into the redraw assembly 1010 to contact a can blank (not shown) located therein and to move the can blank through conventional can forming and ironing dies (not shown) in the housing 1008 to form an elongated can body. The elongated ram 1014 has a second end portion 1022 which is securely mounted in connecting means 1024. Apparatus 1026 extends from machinery, such as the straight line motion assembly described in the Maytag patent, which provides the apparatus 1026 with a reciprocating linear motion. A connecting arm 1028 is connected to the apparatus 1026 and the connecting means 1024 to transmit the reciprocating linear motion to the connecting means 1024 and the elongated ram 1014 as described below.

A liquid bearing 1030 is mounted in a support structure 1032 which is mounted on the support beams 1004 so as to hold the liquid bearing 1030 at a fixed location The liquid bearing 1030, described more fully below, has a generally cylindrical inner surface 1034, FIG. 28, having a diameter slightly greater than the diameter of the generally cylindrical outer surface 1018 to provide for sliding movement of the main body portion 1016 through the liquid bearing 1030. The difference in diameters between the generally cylindrical outer surface 1018 and the generally cylindrical inner surface 1034 is between about 0.0006 and 0.0012 of an inch. The support structure 1032 has spaced apart inlet means 1036 for supplying liquid to the liquid bearing 1030, described more fully below, and spaced apart outlet means 1038 for removing liquid from the liquid bearing 1030, described more fully below. The elongated ram 1014 during the reciprocation thereof by the reciprocating drive means 1026 is supported solely by the liquid bearing 1030.

The front portion 1020 of the elongated ram 1014 comprises a reduced diameter portion 1040 over which there is mounted a hollow punch sleeve 1042. A punch sleeve retaining bolt 1044 is threadedly mounted in a threaded opening 1046 and bears against a radially inwardly directed flange portion 1048 on the punch sleeve 1042 to hold the punch sleeve 1042 on the first end portion 1020.

The connecting means 1024 are specifically illustrated in FIGS. 20–25 and comprise a block member 1050 having a central body portion 1052. A pair of spaced apart support arms 1054, FIG. 1, project outwardly from the central body portion 1052 in a direction toward the reciprocating drive means 1026 and have aligned central openings 1056. A support member 1058 projects outwardly from the central body portion 1052 in a direction toward the liquid bearing 1030. The support member 1058 has a semi-circular opening 1060 having a longitudinal axis that is parallel to the direction of reciprocation of the reciprocating drive means 1026. A semi-circular rib 1062 projects radially inwardly from the semi-circular opening 1060. The second end portion 1022 has an annular recess 1064 formed therein as is located so that when the second end portion 1022 is placed in the support member 1058, the semi-circular rib 1062 is located in a half portion of the annular recess 1064. A clamping member 1066 has an semi-circular opening 1068 formed therein having a longitudinal axis that is parallel to the direction of reciprocation of the reciprocating drive means 1026. A semi-circular rib 1070 projects radially inwardly from the semi-circular opening 1068 and is adapted to fit into the other half portion of the annular recess 1064. The support member 1058 has a plurality of threaded openings 1072. A plurality of headed threaded bolts 1074 pass through openings 1076 in the clamping member 1066 and engage abutments 1078 in the clamping member 1066 and are threadedly engaged in the threaded openings 1072 to hold the clamping member 1066 on the support member 1058 and with the semi-circular rib 1070 in the other half portion of the annular recess 1064. The tolerance between the ribs 1062 and 1070 and the annular recess 1064 is extremely close so as to prevent any substantial relative movement between the elongated ram 1014 and the block member 1050. The central body portion 1052 is provided with a plurality of threaded openings 1080. A plurality of headed threaded bolts 1082 pass through openings 1084 and engage abutments in the clamping member 1066 and are threadedly engaged in the threaded openings 1080 to hold the clamping member 1066 securely on the central body portion 1052. A passageway 1086 in the central body portion 1052 is in liquid communication with a passageway 1088 extending through the elongated ram 1014 for conventional purposes.

The other portion of the connecting means 1024 comprises the connecting arm 1028, which is similar to the connecting rod 23 of Maytag and is connected to the straight line motion assembly 20 thereof in a similar manner, having a central portion comprising a pair of spaced apart arm members 1092. A ring shaped member 1094 is integral with the arm members 1092 at one end thereof and is adapted to be connected to the reciprocating drive means 1026 in the same manner as the connecting rod 23 of the Maytag patent is connected to the straight line motion assembly 20. A body member 1096 is integral with the arm members 1092 at the other end thereof and has a central opening 1098 in which is seated a ring shaped bushing 1100. A connecting pin 1102, FIGS. 17, 24 and 25, extends through the openings 1056 and the bushing 1100 to connect the connecting arm 1028 to the support arms 1054 of the block member 1050. The connecting pin 1102 has a central body portion 1104 having a generally cylindrical outer surface 1105, FIGS. 24 and 25, and spaced apart end portions 1106 having generally planar surfaces 1107. A threaded opening 1108, FIG. 21, extends through each support arm 1054 into the opening 1056 and a threaded set screw 1109 having a flat bottom for contacting a planar surface is located in each threaded opening 1108 so that the set screws 1109 may be tightened to hold the connecting pin 1102 in a fixed position so that the connecting arm 1090 can pivot around the connecting pin 1102.

The liquid bearing 1030 and its support structure 1032 is illustrated specifically in FIGS. 16, 19 and 26–28. The support structure 1032 comprises an integral casting preferably formed from cast iron and has a pair of linearly extending beams 1110 each having a generally planar bottom surface 1112. A plurality of reinforcing ribs 1114 extend between and are integral with the beams 1110. A central body portion 1116 having a longitudinal axis extending in a direction parallel to the direction of movement of the reciprocating drive means 1026 has a pair of oppositely projecting integral flanges 1118 which are integral with the beams 1110 and the reinforcing ribs 1114. The central body portion 1116 has a generally cylindrical outer surface 1120 except for two opposite radially outward projections 1122 having generally planar surfaces 1124. The central body portion 1116 has a generally cylindrical inner surface 1126 in which are formed two spaced apart radially outwardly extending annular recesses 1128.

The liquid bearing 1030 comprises an elongated body portion 1140 having a longitudinal axis which, when the liquid bushing 1030 is mounted in the central body portion 1116, coincides with the longitudinal axis thereof. The elongated body portion 1140 has a generally cylindrical outer surface 1142 in which are formed two spaced apart radially inwardly extending annular recesses 1144 which are adapted to be aligned with the annular recesses 1128 to form annular passageways 1146, FIG. 28, each of which is in liquid communication with an inlet opening 1036. A plurality of relatively narrow radially inwardly extending annular grooves 1148 are formed in the generally cylindrical outer surface 1142 and in which are seated elastomeric O-rings 1150 so as to form a seal between the generally cylindrical outer surface 1142 and the generally cylindrical inner surface 1126 to seal off the passageways 1146. The diameter of the generally cylindrical outer surface 1142 is only slightly smaller than the diameter of the generally cylindrical inner surface 1126 so as to provide a close tolerance fit. The elongated body portion 1140 has a generally cylindrical inner surface 1034 in which are formed a plurality of radially outwardly extending pocket cavities 1154 each of which has an arcuate surface 1156 which is a portion of a cylindrical surface having an axis which is offset from the longitudinal axis of the elongated body portion 1140. A centrally located radially extending generally cylindrical passageway 1158 is in liquid communication with each pocket cavity 1154 and one of the passageways 1146. Suitable adjustable fittings 1160, FIGS. 29 and 30, are used in the passageways 1158 to control the amount of liquid flowing into the pocket cavities 1154 at desired pressures so as to control the temperature of the elongated ram 1014 and the punch sleeve 1042. The adjustable fitting 1160 has a generally cylindrical outer surface 1162 which is slightly smaller than the generally cylindrical passageway 1158 and is in threaded engagement 1164 therewith at the radially innermost end of the generally cylindrical passageway 1158. Tool engaging slots 1166 are provided for rotating the adjustable fitting 1160 into the threaded engagement 1164. The adjustable fitting 1160 has a central opening 1168 in liquid communication with the annular passageway 1146. A set screw 1170 is threadedly mounted in the adjustable fitting 1160 and has a conical lower surface 1172 adapted to vary the size of the entrance into the central opening 1168 so as to vary the rate of flow therethrough. A plurality of passageways 1174 provide for the flow of liquid past the set screw 1170 and into the central opening 1168. The set screw 1170 is provided with a pocket 1176 into which a tool may be inserted to adjust the set screw 1170. Access openings 1177 are provided in the central body portion 1116 for permitting insertion and adjustment of the adjustable fittings 1160 and when the liquid bearing is in use, these access openings 1177 are sealed with plug means (not shown).

An annular end cap 1178, FIG. 29, is provided for each end of the liquid bearing 1030 and has an outer generally cylindrical surface 1180 having a diameter greater than the diameter of the generally cylindrical outer surface 1142 and an inner generally cylindrical surface 1182 having a diameter greater than the generally cylindrical outer surface 1142 but less than the diameter of the generally cylindrical outer surface 1180. An integral extension member 1184 on each end cap 1178 projects axially inwardly toward the elongated body portion 1140 and has a generally cylindrical outer surface 1186 that has a diameter slightly less than the diameter of the generally cylindrical inner surface 1126 of the central body portion 1116 for providing a snug fit therebetween and a generally cylindrical inner surface 1188 having a diameter slightly greater than the diameter of the generally cylindrical outer surface 1018 of the main body portion 1016 to provide for a snug fit therebetween. A plurality of integral spaced apart projections 1190 extend inwardly from the extension member 1184 and are adapted to contact the ends of the elongated body portion 1140. A ring shaped cover plate 1192 has an outer diameter substantially the same as the diameter of the generally cylindrical outer surface 1180 and an inner diameter slightly greater than the generally cylindrical outer surface 1018. A seal 1194 is positioned in the space between each cover plate 1192 and extension member 1184 so as to prevent the escape of liquid from the liquid bearing 1030. A plurality of spaced apart headed threaded bolts 1196 pass through openings in the cover plates 1192, the end caps 1178 and are engaged in threaded openings (not shown) in the ends of the central body portion 1116 to secure the elongated body portion 1140 in fixed relationship to the central body portion 1116. An annular passageway 1198 is formed between each of the extension members 1184 and the ends of the elongated body member 1140 and is in liquid communication with an outlet opening 1038. A centrally located radially outwardly directed annular recess 1200 is formed in the generally cylindrical inner surface 1034 and is in liquid communication with an outlet opening 1038.

In this preferred embodiment of the invention, the liquid bearing 1030 is a liquid bearing which uses the same type of coolant that is used to cool the forming and ironing dies. Liquid conducting means 1202 are connected to the coolant storage tank 1204 and to suitable fittings 1206 in the inlet openings 1036 so that coolant will flow from the coolant storage tank 1204 through inlet openings 1036, passageways 1146 and adjustable fittings 1160 to the pocket cavities 1154. Liquid conducting means 1207 extend between fittings 1208 in the liquid outlet openings 1038 and a coolant return tank 1209 so that coolant will flow from the passageways 1198 and 1200, through the outlet openings 1038 and into the coolant return tank 1209. Conventional means (not shown) treat the returned coolant and feed it back into the coolant storage tank. The coolant comprises about 97 per cent water to which are added solubles The coolant is supplied at suitable pressures between about 150 and 500 psi and preferably about 250 psi.

In operation, the support beams 1004 are machined and supported so that the upper surfaces thereof lie in a common plane. The housing 1008 and the support structure 1032 are mounted on the support beams 1004 so that the longitudinal axes thereof coincide Also, the redraw assembly 1010 is mounted on the housing 1008 so that its longitudinal axis also coincides therewith. The elongated ram 1014 is slidably mounted in the liquid bearing 1030 and the second end portion 1022 is secured in the connecting means 1024. The elongated ram 1014 is supported solely by the liquid bearing 1030. In order to accomplish this, the liquid bearing 1030 has an axial length that is between about 4 to 8 times the diameter of the elongated ram 1014. The pivotal mounting of the apparatus 1026 on the ring shaped member 1094 and of the body member 1096 functions to dampen out any slight vertical movement of the apparatus 1026. Also, the shock absorbing member 1224 prevents any undesirable movement of the second end portion 1022 in a downward direction. The end of the liquid bearing 1030 is spaced from the redraw assembly 1010, at its closest position relative thereto, at an axial distance of between about 1.0 and 2.0 inches. Since the main body portion 1016 is supported by the coolant in the liquid bearing 1030 as it reciprocates therein, there is virtually no wear on the main body portion 1016 or the liquid bearing 1030. As the elongated ram 1014 is reciprocated, the front end portion 1020 thereof functions in a conventional manner to enter into the redraw assembly 1010 to engage a can blank and to move the can blank through the forming and ironing dies to form an elongated can body and to have the formed elongated can body stripped therefrom during its return stroke. The coolant in the liquid bearing 1030 functions to maintain the elongated ram and the punch sleeve at a desired temperature so that elongated can bodies of more constant wall thickness may be produced. Also, the relatively close tolerances between the cylindrical inner surface 1034 of the liquid bearing 1030 and the generally cylindrical outer surface 1018 of the main body portion ensures the proper alignment of punch sleeve 1042 as it passes through the redraw assembly 1010 and the housing 1008 having the forming and ironing dies therein.

While illustrative and presently preferred embodiments of the invention has been described in detail herein, it is to be understood that the inventive concepts may be otherwise variously embodied and employed and that the appended claims are intended to be construed to include such variations except insofar as limited by the prior art.

What is claimed is:

1. A can body maker for forming can blanks into elongated can bodies comprising:

a can body maker having a fixedly located frame;

at least a pair of elongated shafts fixedly mounted on said frame;

a ram carriage;

bearing means in said ram carriage for slidably mounting said ram carriage for reciprocal movement over said shafts;

said bearing means comprising liquid bearings;

storage means for storing a quantity of coolant;

said coolant comprising water having solubles contained therein;

conduit means for supplying a portion of said coolant for said liquid bearings as said liquid therefor;

a ram fixedly mounted on said ram carriage;

reciprocating means for applying reciprocating forces to said ram carriage;

a housing having tooling and ironing dies located therein mounted at a fixed location;

fixedly mounted guide bearing means for slidably receiving and supporting said ram;

said guide bearing means being located between said housing and said ram carriage;

a redraw assembly slidably mounted for independent reciprocal movement and located between said housing and said guide means;

an opening in said redraw assembly through which said ram passes and permitting relative sliding movement between said ram and said redraw assembly; and can blank feeding means on said redraw assembly for positioning a can blank so that it can be contacted by said ram and moved through said housing to form an elongated can body.

2. The invention as in claim 1, wherein:

said coolant supplied to each of said liquid bearings is at a pressure of between about 150 and 500 psi.

3. The invention as in claim 2 wherein:

said pressure is about 200 psi.

4. The invention as in claim 1 wherein:

said guide bearing means comprises a liquid bearing.

5. The invention as in claim 1 and further comprising:

said ram carriage bearing means having pressure equalization means for equalizing the pressures so that said ram carriage moves over said shafts in an equilibrium position.

6. The invention as in claim 1 and further comprising:

each of said at least two shafts has a longitudinal axis; and said at least two shafts are fixedly mounted so that said longitudinal axes lie in the same generally horizontal plane.

7. The invention as in claim 6 wherein:

each of said at least two shafts has a cylindrical outer surface; and each of said liquid bearings has a generally cylindrical inner surface.

8. The invention as in claim 7 and further comprising:

at least two sets of axially spaced apart pocket formations formed in said generally cylindrical inner surface of each of said liquid bearings; and at least four equally spaced apart pocket cavities in each set.

9. The invention as in claim 8 and further comprising:

each of said pocket cavities having an arcuate surface that is a portion of a cylindrical surface that has an axis offset from the axis of said generally cylindrical surface of each of said liquid bearings.

10. The invention as in claim 8 and further comprising:

each of said liquid bearings having a generally planar top surface;

each of said liquid bearings having at least one liquid inlet and at least one liquid outlet in said generally planar top surface;

manifold means mounted on said generally planar top surfaces for feeding liquid to each of said liquid bearings;

said manifold means having at least one liquid inlet;

liquid supplying means for supplying liquid to said liquid inlet of said manifold means; and a plurality of passageways in said manifold means for supplying said liquid to said liquid inlet of each of said liquid bearings.

11. The invention as in claim 10 and further comprising:

said manifold means having at least one liquid outlet; and a plurality of passageways in each of said liquid bearings for collecting used liquid and delivering such used liquid to said liquid outlet of said manifold means.

12. The invention as in claim 11 and further comprising each of said pocket cavities having an arcuate surface that is a portion of a cylindrical surface that has an axis offset from the axis of said generally cylindrical surface of each of said liquid bearings.

13. The invention as in claim 8 wherein said redraw assembly comprises:

at least a pair of spaced apart support posts fixedly mounted on said housing;

said pair of spaced apart support posts projecting out of said housing in a direction toward said ram reciprocation means;

a redraw carriage having at least a pair of spaced apart bearings fixedly mounted therein;

said pair of spaced apart bearings being slidably mounted on said pair of spaced apart support posts to provide substantially friction-free movement of said redraw carriage; and redraw reciprocation means for reciprocating said redraw carriage.

14. The invention as in claim 13 wherein:

each of said pair of spaced apart, support posts has a substantially cylindrical outer surface; and each of said pair of spaced apart bearings has a substantially cylindrical inner surface.

15. The invention as in claim 14 wherein:

each of said pair of spaced apart, support posts has a longitudinal axis parallel to said longitudinal axis of said reciprocating ram; and each of said pair of spaced apart bearings has a longitudinal axis parallel to said longitudinal axis of said reciprocating ram.

16. The invention as in claim 15 wherein each of said pair of spaced apart bearings comprises:

a longitudinally extending bore in said redraw mechanism; and a bushing fixedly mounted in said bore.

17. The invention as in claim 13 wherein said redraw reciprocation means comprises:

an elongated redraw actuating bar;

connecting means for connecting one end of said redraw actuating bar to said redraw carriage;

a cam follower lever connected to the other end of said redraw actuating bar;

a cam follower mounted on said cam follower lever;

a rotatable cam mounted for rotation at a fixed location;

rotation means for rotating said rotatable cam; and force applying means for applying a force to said redraw actuating bar to urge said cam follower against said rotatable cam means to provide said reciprocating movement to said redraw carriage.

18. The invention as in claim 17 and further comprising:

counterbalancing means for applying a force to said redraw actuating bar to counterbalance the weight thereof.

19. The invention as in claim 11 and further comprising:

annular passageways formed in each of said liquid bearings for receiving liquid from said liquid inlet means of each of said liquid bearings; and liquid feeding means for feeding liquid from said annular passageways to each of said pocket cavities.

20. A liquid bearing for use with the ram of a can body maker for forming can blanks into elongated can bodies comprising:

a body maker apparatus for forming can blanks into elongated can bodies;

said body maker apparatus having can forming and ironing dies supported at a fixed location;

a storage tank having a liquid coolant stored therein;

said liquid coolant comprising water having solubles contained therein;

at least one liquid bearing;

support means for mounting said liquid bearing at a fixed location;

conduit means for supplying portions of said liquid coolant to said liquid bearing and returning portions of said liquid coolant to said storage tank;

said body maker apparatus having a ram;

a redraw assembly located between said can forming and ironing dies and said liquid bearing;

an opening in said redraw assembly through which said ram passes;

can blank feeding means on said redraw assembly for positioning a can blank so that it can be contacted by said ram and moved through said can forming and ironing dies;

reciprocating means for moving said ram through said redraw assembly and into contact with said can blank and to move said can blank into and through said can forming and ironing dies and to retract said ram out of said can forming and ironing dies; and said liquid bearing being located so that at least a portion of said ram is located within said liquid bearing prior to said contact with said can blank, during movement of said ram through said can forming and ironing dies and after said retraction of said ram.

21. A liquid bearing as in claim 20 wherein:

said liquid coolant supplied to said liquid bearing is at a pressure of between about 150 and 500 psi.

22. A liquid bearing for use with the ram of a can body maker for forming can blanks into elongated can bodies comprising:

a body maker apparatus for forming can blanks into elongated can bodies;

said body maker apparatus having can forming and ironing dies supported at a fixed location;

a storage tank having a liquid coolant stored therein;

said liquid coolant comprising water having solubles contained therein;

at least one liquid bearing having a generally cylindrical inner surface;

support means for mounting said liquid bearing at a fixed location;

said liquid bearing having at least one set of pocket formations;

a plurality of equally spaced apart pocket cavities in said at least one set;

conduit means for supplying portions of said liquid coolant to said liquid bearing and returning portions of said liquid coolant to said storage tank;

said body maker apparatus having a ram;

a redraw assembly located between said can forming and ironing dies and said liquid bearing;

an opening in said redraw assembly through which said ram passes;

can blank feeding means on said redraw assembly for positioning a can blank so that it can be contacted by said ram and moved through said can forming and ironing dies;

reciprocating means for moving said ram through said redraw assembly and into contact with said can blank and to move said can blank into and through said can forming and ironing dies and to retract said ram out of said can forming and ironing dies; and said liquid bearing being located so that at least a portion of said ram is located within said liquid bearing prior to said contact with said can blank; during movement of said ram through said can forming and ironing dies and after said retraction of said ram.

23. The invention as in claim 22 and further comprising:

each of said pocket cavities having an arcuate surface that is a portion of a cylindrical surface that has an axis offset from the axis of said generally cylindrical inner surface.

24. A ram assembly for a can body making apparatus used for forming can blanks into elongated can bodies comprising:

a fixedly mounted support frame;

a housing having forming and ironing dies located therein mounted on said support frame;

a redraw assembly mounted for sliding movement on said housing;

an elongated ram having a main body portion having a generally cylindrical outer peripheral surface;

said elongated ram having a first end portion for movement into said redraw assembly to contact a can blank in said redraw assembly and to move said can blank out of said redraw assembly and through said forming and ironing dies to form an elongated can body;

said elongated ram having a second end portion;

a reciprocating drive means for providing reciprocal linear movement for said elongated ram;

connecting means on said second end portion for connecting said elongated ram to said reciprocating drive means;

a storage tank having a liquid coolant stored therein;

said liquid coolant comprising water having solubles contained therein;

at least one liquid bearing having a generally cylindrical inner surface having a diameter slightly greater than the diameter of said main body portion to provide for sliding movement of said main body portion through said liquid bearing;

conduit means for supplying portions of said liquid coolant to said liquid bearing and for returning portions of said liquid coolant to said storage tank;

support means mounted on said support frame for holding said liquid bearing at a fixed location; and said elongated ram being supported solely by said liquid bearing during the reciprocation thereof by said reciprocating drive means.

25. The invention as in claim 24 wherein:

the difference in diameter between said main body portion and said liquid bearing is between about 0.0006 and 0.0012 of an inch.

26. The invention as in claim 24 wherein said liquid bearing comprises:

a first end portion closer to said redraw assembly and a second end portion closer to said connecting means;

at least two sets of axially spaced apart pocket formations in said generally cylindrical inner surface of said liquid bearing;

at least four equally sized and spaced apart pocket cavities in each of said sets; and sealing means for forming a seal between said first and second end portions and said generally cylindrical outer surface of said main body portion of said elongated ram for holding said coolant within said liquid bearing to maintain said pressure therein.

27. The invention as in claim 26 wherein:

said liquid bearing has a length between about 4 to 8 times the diameter of said elongated ram.

28. The invention as in claim 27 wherein:

said first end portion is spaced from said redraw assembly when said redraw assembly is at its closest position to said first end portion a distance equal to between about 1.0 and 2.0 inches.

29. The invention as in claim 28 wherein:

the pressure of said liquid coolant in said liquid bearing is about 250 psi.

30. The invention as in claim 24 wherein said support means for said liquid bearing comprises:

a pair of spaced apart linearly extending beams mounted on said support frame;

a plurality of spaced apart reinforcing ribs extending between and connected to said pair of spaced apart linearly extending beams;

a central body portion having a generally cylindrical inner surface;

a pair of outwardly projecting flanges on said central body portion and connected to said reinforcing ribs and said pair of spaced apart linearly extending beams; and said liquid bearing mounted in said generally cylindrical inner surface of said central body portion and having a generally cylindrical outer surface radially opposite thereto.

31. The invention as in claim 30 wherein said liquid bearing comprises:

a first end portion closer to said redraw assembly and a second end portion closer to said connecting means;

at least two sets of axially spaced apart pocket formations in said generally cylindrical inner surface of said liquid bearing;

at least four equally sized and spaced apart pocket cavities in each of said sets; and sealing means for forming a seal between said first and second end portions and said generally cylindrical outer surface of said main body portion of said elongated ram for holding said liquid coolant within said liquid bearing to maintain said pressure therein.

32. The invention as in claim 31 and further comprising:

a pair of spaced apart annular passageways located between said central body portion and said liquid bearing and in liquid communication with said inlet means;

a plurality of openings, each of which extends between one of said annular passageways and one of said pocket cavities, for supplying said liquid coolant to said pocket cavities; and sealing means between said central body portion and said liquid bearing to prevent the escape of said liquid coolant.

33. The invention as in claim 32 wherein said spaced apart annular passageways comprises:

a pair of spaced apart annular recesses formed in said generally cylindrical inner surface of said central body portion;

a pair of spaced apart annular recesses formed in said generally cylindrical outer surface of said liquid bearing; and said pairs of annular recesses being radially opposite to each other so as to form said spaced apart annular passageways.

34. The invention as in claim 33 wherein:

each of said spaced apart annular recesses having an axial extent equal to the axial extent of said pocket cavities.

35. The invention as in claim 33 wherein said sealing means comprises:

a pair of spaced apart annular grooves extending radially inwardly in said generally cylindrical outer surface of said liquid bearing;

each of said pair of annular recesses in said generally cylindrical outer surface of said liquid bearing being located between a pair of said annular grooves; and an elastomeric O-ring sealing gasket seated in each of said annular grooves and having at least a portion thereof in contact with radially opposite portions of said generally cylindrical inner surface of said central body portion.

36. The invention as in claim 33 and further comprising:

liquid control means in each of said openings extending between said liquid passageways and said pocket cavities for controlling the rate of flow of said liquid coolant into said pocket cavities for maintaining at least said first end portion o said elongated ram at desired temperatures.

37. The invention as in claim 36 wherein:

the pressure of said liquid coolant in said liquid bearing is between 100 and 500 psi.

38. The invention as in claim 37 wherein:

the difference in diameter between said main body portion and said liquid bearing is between about 0.0006 and 0.0012 of an inch.

* * * * *